US006616554B2

(12) United States Patent
Liao

(10) Patent No.: US 6,616,554 B2
(45) Date of Patent: Sep. 9, 2003

(54) TRAINING DEVICE FOR BASEBALL HITTING

(76) Inventor: Grace Liao, 9F1., No. 196, Minsheng Rd., Hsinchu (TW)

( * ) Notice: Subject to any disclaimer, the term of this patent is extended or adjusted under 35 U.S.C. 154(b) by 0 days.

(21) Appl. No.: 09/934,786

(22) Filed: Aug. 22, 2001

(65) Prior Publication Data

US 2003/0038426 A1 Feb. 27, 2003

(51) Int. Cl.[7] ..... A63B 69/00; A63B 71/00

(52) U.S. Cl. ..... 473/417; 473/422

(58) Field of Search ..... 473/415, 417, 473/418, 422, 423, 429, 454; D21/715–719; 482/87, 90, 160; 248/516

(56) References Cited

U.S. PATENT DOCUMENTS

| | | | | | |
|---|---|---|---|---|---|
| 808,528 | A | * | 12/1905 | Finney et al. | 482/90 |
| 1,703,012 | A | * | 2/1929 | McNamara | 482/90 |
| 2,272,765 | A | * | 2/1942 | Beeson et al. | 473/417 |
| 2,616,692 | A | * | 11/1952 | Bird | 473/417 |
| 2,862,712 | A | * | 12/1958 | Delia et al. | 473/423 |
| 3,176,986 | A | * | 4/1965 | Posatsky | 482/119 |
| 3,183,000 | A | * | 5/1965 | Dix | 473/417 |
| 3,874,662 | A | * | 4/1975 | Harrington | 473/417 |
| 4,139,193 | A | * | 2/1979 | Felber et al. | 482/90 |
| 4,364,563 | A | * | 12/1982 | Stafford | 273/DIG. 4 |
| 4,830,371 | A | * | 5/1989 | Lay | 473/423 |
| 5,386,987 | A | * | 2/1995 | Rodino, Jr. | 473/429 |
| 5,580,047 | A | * | 12/1996 | Shih et al. | 473/417 |
| 5,772,536 | A | * | 6/1998 | Wang | 473/417 |
| 5,916,045 | A | * | 6/1999 | Busch | 473/417 |
| 6,045,462 | A | * | 4/2000 | Mourek | 473/417 |
| D430,243 | S | * | 8/2000 | Alberti et al. | D21/715 |
| D430,629 | S | * | 9/2000 | Alberti | D21/719 |
| 6,398,671 | B1 | * | 6/2002 | Rios | 273/317.6 |

* cited by examiner

*Primary Examiner*—Paul T. Sewell
*Assistant Examiner*—Mitra Aryanpour

(57) ABSTRACT

A training device for baseball hitting has a baseboard, a resilient column with one end securely yet rotatably engaged with the baseboard and a receiving tube securely connected to the other end of the resilient column. The resilient column has a bendable and shapable upper portion. The rotatable engagement between the resilient column and the baseboard allows the resilient column to incline to any desired direction and the shapable upper portion of the resilient column allows the resilient column to bend to any desired position.

1 Claim, 3 Drawing Sheets

TRAINING DEVICE FOR BASEBALL HITTING

FIELD OF THE INVENTION

The present invention relates to a training device, and more particularly to a training device for hitting a baseball. The training device has a baseboard, a resilient column extending from the baseboard and a cushion mounted outside the resilient column. With such an arrangement, the resilient column is able to change to any desired direction as required.

BACKGROUND OF THE INVENTION

A conventional training device for hitting a baseball is shown in U.S. Pat. No. 5,580,047 (hereinafter referred to as '047), which comprises a baseboard, a tubular column, a transverse arm rotatably mounted on the free end of the tubular column and a flexible duct extending upward relative to the transverse arm. On the free end of the flexible duct, a bearing disk is provided to support the baseball.

When the training device of this kind is in use, the user is able to use the adjusting ring to adjust the height of the tubular column and the transverse arm to adjust the position of the free end of the bearing disk so that the user of different height is able to use the training device for hitting practice, no matter if the user is right-handed or left-handed.

However, when adjusting the height or the position of the bearing disk, the user will have to stop practicing to loosen the adjusting ring and the orientation of the transverse arm. After every thing is properly adjusted, the hitting practice may start again, which is too troublesome for the user. Furthermore, because of the transverse arm, there is no way to place the baseball in the center above the baseboard, which means the user may have no chance to practice hitting the baseball coming directly toward the center of the baseboard. In other words, the user may have to use a stick mounted directly on the center of the baseboard to practice hitting the baseball coming toward the center of the baseboard. Accordingly, the training device of the '047 patent is not handy and causes too much trouble for the user.

To overcome the shortcomings, the present invention intends to provide an improved training device to mitigate or obviate the aforementioned problems.

SUMMARY OF THE INVENTION

The primary objective of the invention is to provide a training device for hitting a baseball. The training device has a ball mounted on one end of the resilient column and rotatably received in a securing means for attaching the resilient column on the baseboard so that the user is able to use the ball to change the position of the other end of the resilient column. With the resilience of the resilient column, the user is able to change the height of the resilient column.

Another objective of the invention is to provide an extension rod detachably connected with the other end of the resilient column so that no matter how tall the user is, the training device is able to provide a suitable practicing environment for the user.

Still another objective of the present invention is that the securing means is securely mounted on the baseboard and comprises an opening inside the baseboard for receiving the ball of the resilient column so that with the ball rotatably received in the opening of the securing means the resilient column is able to a to provide a suitable angle for practice.

Other objects, advantages and novel features of the invention will become more apparent from the following detailed description when taken in conjunction with the accompanying drawings.

DETAILED DESCRIPTION OF THE INVENTION

Figure 1:
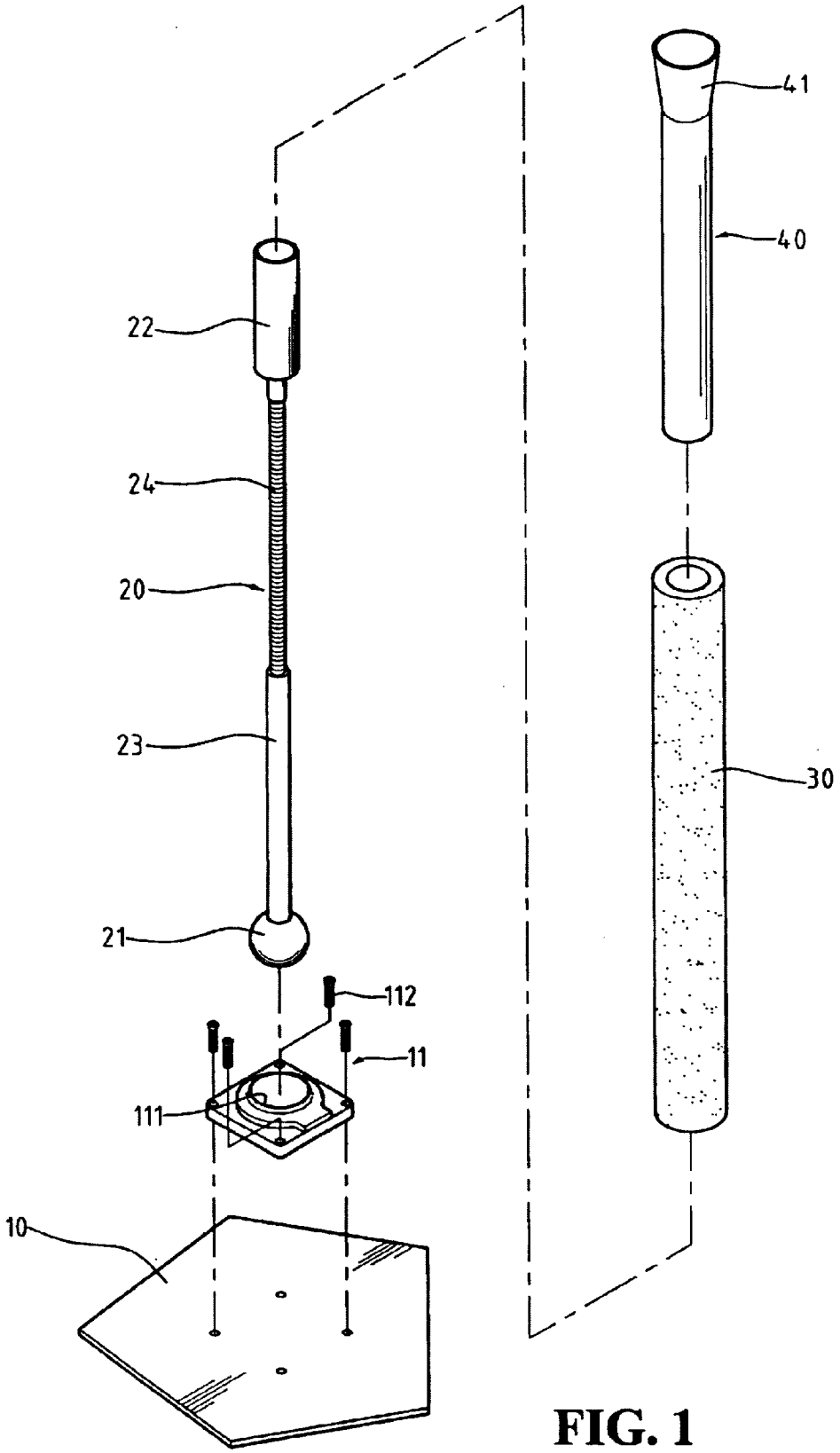
FIG. 1 is an exploded perspective view of the training device of the present invention.
Figure 2:
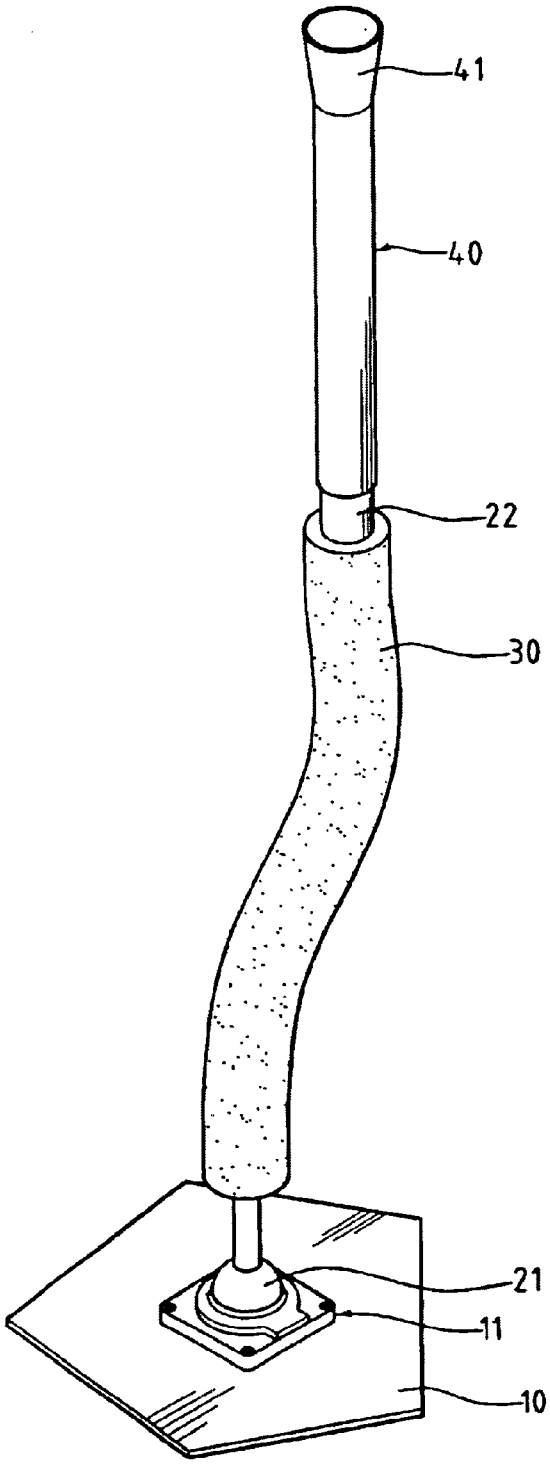
FIG. 2 is a perspective view of the training device of FIG. 1 in assembly.
Figure 3:
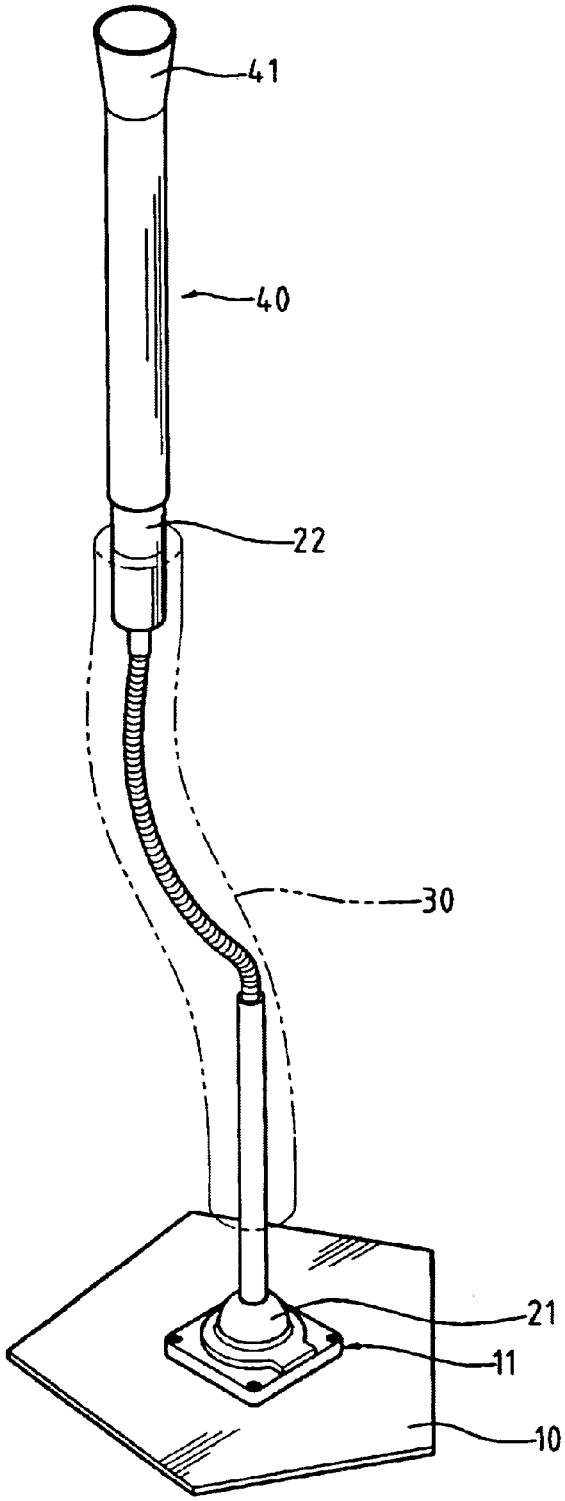
FIG. 3 is a perspective view of the training device orientated toward a different direction to that shown in FIG. 2.

With reference to FIGS. 1, 2 and 3, the training device for baseball hitting has a baseboard 10, a resilient column 20, a cushion 30 and an extension rod 40.

The resilient column 20 has a ball 21 securely connected to the free end of a lower portion 23 of the resilient column 20 and a receiving tube 22 securely connected to the free end of an upper portion 24 of the resilient column 20. As shown in FIGS. 1–3, the upper portion 24 of the resilient column 20 is bendable and shapable. When the upper portion 24 is bent, it stays in its bent shape. By bending the upper portion 24, the receiving tube 22 can be adjusted to a different location with a different height but still kept in a straight up position.

The cushion 30 is made of a tube and is made of a material that is elastic so that the cushion 30 is able to be mounted around the resilient column 20 except the ball 21 and the receiving tube 22.

The extension rod 40 has a diameter slightly larger than a diameter of the receiving tube 22 so that one end of the extension rod 40 is able to detachably connect with the free end of the receiving tube 22. Furthermore, the other end of the extension rod has a cup 41 provided to support a baseball (not shown). As can be seen from FIGS. 1 and 2, the extension rod 40 is telescopically received over the receiving tube 22 which is securely mounted to the free end of the upper portion 24 of the resilient column 20.

When the device of the invention is assembled, the ball 21 of the resilient column 20 is securely yet rotatably received in a securing means 11 that is securely engaged with the baseboard 10. The securing means 11 has an opening 111 defined to receive the ball 21 and is securely engaged with the baseboard 10 by screws 112. Then, the cushion 30 is mounted around the resilient column 20 with the receiving tube 22 exposed outside the cushion 30.

With such an arrangement, the user is able to bend the resilient column 20 to any desired angle with the receiving tube 22 orthogonal to the ground. If the length of the resilient column 20 is not enough for the user, the user is able to use the extension rod 40 to increase the overall length of the resilient column 20. The cushion 30 outside the resilient column 20 is able to protect the resilient column 20 from being directly hit by the user and the ball 21 is able to provide the user with an expected inclination of the resilient column 20.

It is concluded that the training device is simple in structure and convenient to use. The user is able to simultaneously or separately adjust the angle and/or inclination of the resilient rod 20 as required.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A training device for baseball hitting, comprising:

a baseboard;

a securing means securely mounted on said baseboard and having an opening defined therein;

a resilient column having a lower portion connected to a ball which is rotatably received in said opening of said securing means, and an upper portion mounted with a receiving tube;

an extension rod telescopically received over said receiving tube, said extension rod having a cup on a free end for supporting a baseball; and a cushion mounted around said resilient column;

wherein said upper portion of said resilient column is bendable and shapable for positioning said extension rod in a desired location with desired height and keeping said extension rod orthogonal to ground, and said upper portion maintains a bent shape after being bent until said upper portion is reshaped again.

* * * * *